United States Patent [19]

Hausner et al.

[11] Patent Number: 4,519,202

[45] Date of Patent: May 28, 1985

[54] SPINNING OR TWISTING MACHINE, ESPECIALLY FOR GLASS-FIBER THREADS

[75] Inventors: Gerd Hausner, Albershausen; Rolf Semmelrodt, Ebersbach, both of Fed. Rep. of Germany

[73] Assignee: Zinser Textilmaschinen GmbH, Ebersbach, Fed. Rep. of Germany

[21] Appl. No.: 480,868

[22] Filed: Mar. 31, 1983

[30] Foreign Application Priority Data

Apr. 1, 1982 [DE] Fed. Rep. of Germany ..... 3212084

[51] Int. Cl.[3] ..... D01H 13/10; D01H 13/20

[52] U.S. Cl. ..... 57/264; 57/93

[58] Field of Search ..... 57/264, 61, 78, 80, 57/81, 83, 90, 92, 93, 94, 97, 100, 352

[56] References Cited

U.S. PATENT DOCUMENTS

| | | | |
|---|---|---|---|
| 3,445,999 | 5/1969 | De Ruig | 57/94 |
| 3,538,699 | 11/1970 | Cunningham et al. . | |
| 3,555,537 | 1/1971 | Windley | 57/81 X |
| 3,986,330 | 10/1976 | Kuttruff et al. | 57/264 X |
| 4,254,615 | 3/1981 | Adolf et al. | 57/94 X |
| 4,336,684 | 1/1982 | Hartmannsgruber et al. | 57/94 X |
| 4,375,149 | 3/1983 | Hartmannsgruber | 57/78 X |

FOREIGN PATENT DOCUMENTS

| | | |
|---|---|---|
| 591837 | 1/1934 | Fed. Rep. of Germany . |
| 2153697 | 10/1971 | Fed. Rep. of Germany . |
| 2535457 | 10/1971 | Fed. Rep. of Germany . |
| 2218063 | 4/1972 | Fed. Rep. of Germany . |
| 2230628 | 6/1972 | Fed. Rep. of Germany . |

*Primary Examiner*—Donald Watkins

*Attorney, Agent, or Firm*—Karl F. Ross; Herbert Dubno

[57] ABSTRACT

In order to maintain a desired feed velocity in a glass-fiber thread passing via a traveler from a supply bobbin to a cop on a spindle, the thread is led upstream of the traveler through the nip of a pair of rollers that are set in rotation by its motion to drive a tachometer working into a speed regulator which controls the bobbin drive. The output signal of the tachometer may further be used to measure the length of thread payed out from the supply bobbin and/or to generate an alarm signal stopping the bobbin and spindle drives in the event of a slowdown of the roller rotation indicative of a thread break; such an alarm signal could also be produced when a speed sensor coupled with the bobbin drive detects an excessive increase in its operating speed caused in the event of a thread break by feedback from the tachometer.

14 Claims, 5 Drawing Figures

SPINNING OR TWISTING MACHINE, ESPECIALLY FOR GLASS-FIBER THREADS

FIELD OF THE INVENTION

Our present invention relates to textile machinery, particularly to a working station thereof used for the spinning or twisting of threads consisting of relatively fragile strands such as glass fibers, wherein a supply bobbin is rotated by first drive means to pay out a thread that is drawn through a traveler onto a wind-up bobbin or cop on a spindle rotated by second drive means.

BACKGROUND OF THE INVENTION

In the processing of threads composed of capillary glass fibers it is desirable to minimize the number of contacts between the thread and associated guide or feed members disposed along its path, especially members causing a deflection. Thus, the fragility of the glass strands generally prevents the use of roller pairs designed to advance the thread at a prescribed rate, unless the fibers are coated with rubber or the like as taught in U.S. Pat. No. 3,538,699, for example. In practice, therefore, the feed velocity of plain glass-fiber threads is determined by the rotary speed imparted to the supply bobbin by its driving mechanism as well as by the radius of the bobbin at the point where the thread is being pulled off. This radius, however, is not constant but diminishes progressively during unwinding and, usually, also varies over the length of the bobbin.

To minimize the change in the linear thread velocity occurring with a given rotary speed during the unwinding process, which is turn leads to an irregular twist of the thread or yarn being wound up, it is customary to use supply bobbins of relatively large core diameter wound with a thread layer of relatively small thickness. This procedure has several inconveniences, including the considerable moment of inertia of the bobbin which retards its acceleration to the full operating speed at the beginning and its deceleration at the end of the unwinding process as well as when rotation is to be temporarily halted in the event of a thread break. Other drawbacks are the need for a wider spacing of adjacent working stations and the frequent replacements required by the limited length of thread initially carried on such a bobbin.

In textile machinery, as well as in the somewhat remote field of wire drawing, it is known to control the speed of a take-up spool to maintain a prescribed linear feed rate. German laid-open application No. 22 18 063, published Dec. 21, 1972, describes a process and a device for varying the rotary speed of a wind-up spool by controlling its drive motor in response to an output signal from a device measuring yarn speed. German printed specification No. 25 35 457, published Feb. 10, 1977, discloses a somewhat similar arrangement according to which the winding speed is controlled by varying the speed of a drive motor in response to a signal proportional to the power consumption of a synchronous motor operating a feed roller. From German patent No. 591,837 of Jan. 27, 1934 it is further known, in an apparatus for transferring wire from a supply reel to a take-up reel, to drive the latter reel at a constant speed and to vary the rotary speed of the supply reel, under the control of an articulated linkage gauging the wire tension between the two reels, in a manner compensating for the progressive increase in the radius of the wire layer on the take-up reel and the progressive decrease in the radius of the wire layer on the supply reel.

The application of the last-mentioned arrangement to a ring spinner or twister in textile machinery would not solve the problem of requiring a large diameter for the core of the supply bobbin and a relatively thin thread layer thereon as discussed above. Nor would a controlled variation of the spindle speed, by itself, keep the linear thread velocity constant since that velocity depends inter alia on the lag of the frictionally retarded traveler on its guide ring with reference to the spindle rotation. In a yarn-plying operation, however, constancy of twist requires the maintenance of a predetermined relationship between feed rate and spindle speed.

OBJECTS OF THE INVENTION

An important object of our present invention, therefore, is to provide a working station of a textile plant—especially one used for twisting glass-fiber threads into yarn—with speed-control means for maintaining such a relationship without the need for frictionally feeding the threads by driven roller pairs as conventionally used with textile threads of a less delicate nature.

Another object is to utilize such speed-control means also for the detection of possible thread breaks and the automatic stopping of the supply-bobbin and spindle drives in such a case.

SUMMARY OF THE INVENTION

We realize the first of these objects, in accordance with our present invention, by disposing monitoring means between the supply bobbin and the traveler of a working station of the kind referred to in order to generate a velocity-measuring signal indicative of the rate of advance of a thread being payed out by the bobbin. This velocity-measuring signal is fed to a speed regulator coupled with the supply-bobbin drive in order to control the rotation of that bobbin so as to maintain the rate of advance of the thread at the prescribed value. That value could be constant but may also be varied in a predetermined manner with the aid of a programmer coupled with the aforementioned speed regulator. Such a coupling need not be direct but may be through the intermediary of a speed setter for the spindle drive having an output connection extending to the speed regulator, possibly with interposition of an adjustable signal converter designed to correlate the operating speed of the bobbin drive with the spindle speed established by the programmer in order to establish a selected twist rate.

The monitoring means may comprise a rotary member mechanically entrained by the thread, this member working into a tachometric device emitting the velocity-measuring signal. For reasons pointed out above, we prefer to avoid the use of a deflecting roller (as shown in the aforementioned German laid-open application No. 22 18 063) but to provide instead two coacting rollers—one of them being the tachometer-operating rotary member—which clamp the thread between them under moderate pressure, e.g. with the aid of biasing springs gently urging the shaft bearings of one roller toward the other.

The tachometric device advantageously works as a pulse generator so as to emit a train of metering pulses whose recurrence rate is proportional to the rate of advance of the thread being monitored. Such a train of metering pulses can be utilized to step a thread-length counter and/or to generate an alarm signal in response to a significant decrease in the pulse rate indicative of a thread break. This alarm signal, which may simply alert an operator but preferably causes the automatic stopping of the bobbin and spindle drives, could also be generated in some other manner upon the detection of a significant slowdown in the rate of thread advance, specifically with the aid of sensing means coupled to the monitoring means through the intermediary of the speed regulator associated with the bobbin drive. Thus, a thread break—while not immediately stopping the rotation of a roller or other mechanically entrained member forming part of the monitoring means—will result in a deceleration of that member which through feedback via the speed regulator will ineffectually accelerate the bobbin drive beyond the normal range of its operating speed so that a surpassing of the upper limit of that range can generate the alarm signal.

The rotation of the supply bobbin may be controlled either by modifying the operation of a variable-speed motor, individual to the working station considered, or by altering the transmission ratio of a coupling inserted between the bobbin shaft and a drive shaft common to a number of working stations.

The use of tachometers for measuring the speed of a bobbin drive is, of course, well known per se. See, for example, German printed specification Nos. 21 53 697 and 22 30 628 published July 26, 1979 and Sept. 1, 1977, respectively.

BRIEF DESCRIPTION OF THE DRAWING

The above and other features of our invention will now be described in detail with reference to the accompanying drawing in which.

SPECIFIC DESCRIPTION

Figure 1:
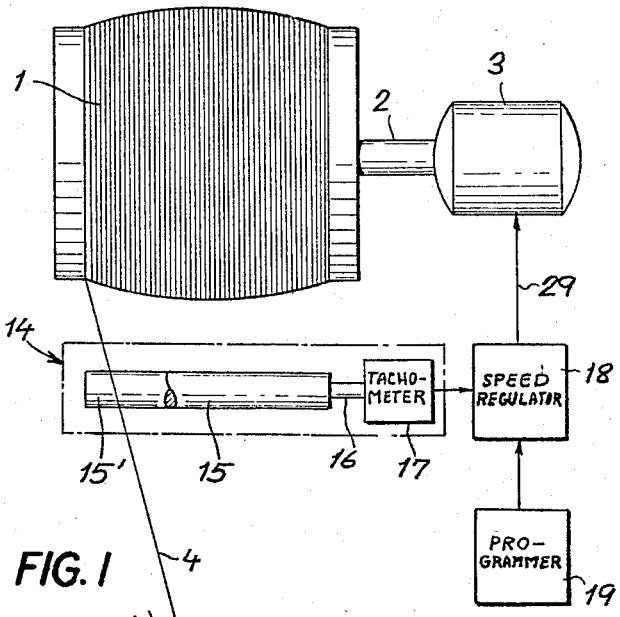
FIG. 1 is a diagrammatic front-elevational view of a working station of a twisting machine embodying our invention.

FIG. 1 shows the essential elements, supported on a nonillustrated frame, of a working station of a twisting machine embodying our invention. That station comprises a supply bobbin 1 on a shaft 2, driven by a variable-speed motor 3, co-operating with a take-up mechanism 9 of conventional structure including a vertically reciprocable ring rail 8 traversed by a spindle 11 which supports a core 12 for the production of a yarn package in the form of a cop 13. A traveler 6 moves along a ring 7 which is carried on rail 8 and is centered on the spindle axis. An eye 5, which may be vertically reciprocable jointly with ring rail 8, guides a thread 4 which is continuously drawn off the bobbin 1 and passes through traveler 6 onto cop 13. Spindle 11 is driven by a motor 10 here assumed to operate at constant speed, though this speed may also be varied as discussed hereinafter with reference to FIGS. 3 and 4.

In accordance with our present invention, a monitoring device 14 interposed between bobbin 1 and thread guide 5 comprises a pair of nondriven rollers 15, 15' clamping the thread 4 between them under a limited spring pressure sufficient for frictional entrainment of the rollers by the advancing thread. Roller 15 has a shaft 16 driving a tachometer 17 which feeds a velocity-measuring signal to a speed regulator 18 controlling the operating speed of drive motor 3.

Another thread 4', from a second supply bobbin not shown, passes through guide 5 and traveler 6 for twisting therewith into a yarn. A monitoring device duplicating the one shown at 14 senses the velocity of thread 4' and controls, through another speed regulator and drive motor, the rotation of the second bobbin.

Speed regulator 18 may include a comparator designed to detect any difference, in amplitude (in the case of a voltage) or frequency (in the case of a pulse train), between the monitoring signal and a reference signal which may have a constant value if the linear thread velocity is to be maintained substantially invariable. However, as also indicated in FIG. 1, speed regulator 18 may be connected to a programmer 19 which modifies that reference signal in a predetermined manner for a desired variation of the thread-feeding rate, e.g. to alter the twist or to accommodate a variable-speed drive for spindle 11.

Figure 2:
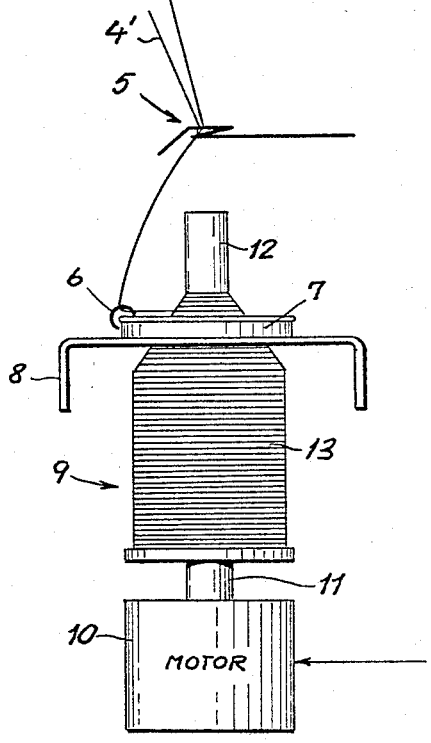
FIG. 2 is a front-elevational view of a supply bobbin of such a station provided with a modified driving mechanism.
Figure 2:
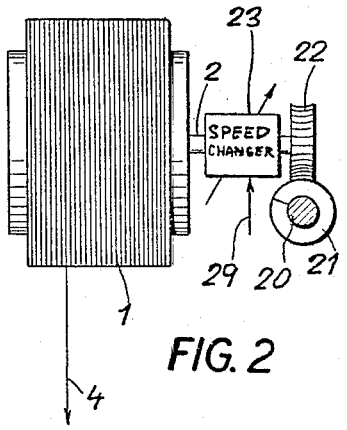

The output lead 29 of speed regulator 18 need not terminate at a variable-speed motor individual to a given supply bobbin, as shown in FIG. 1, but, as illustrated in FIG. 2, could extend to an adjustable speed changer 23 inserted between the bobbin shaft 2 and a drive shaft 20 common to a plurality of bobbins including, for example, the one supplying the thread 4' in FIG. 1. Speed changer 23 has an input shaft coupled with drive shaft 20 via a worm 21 and a worm gear 22 representative of a variety of step-down transmissions.

Figure 3:
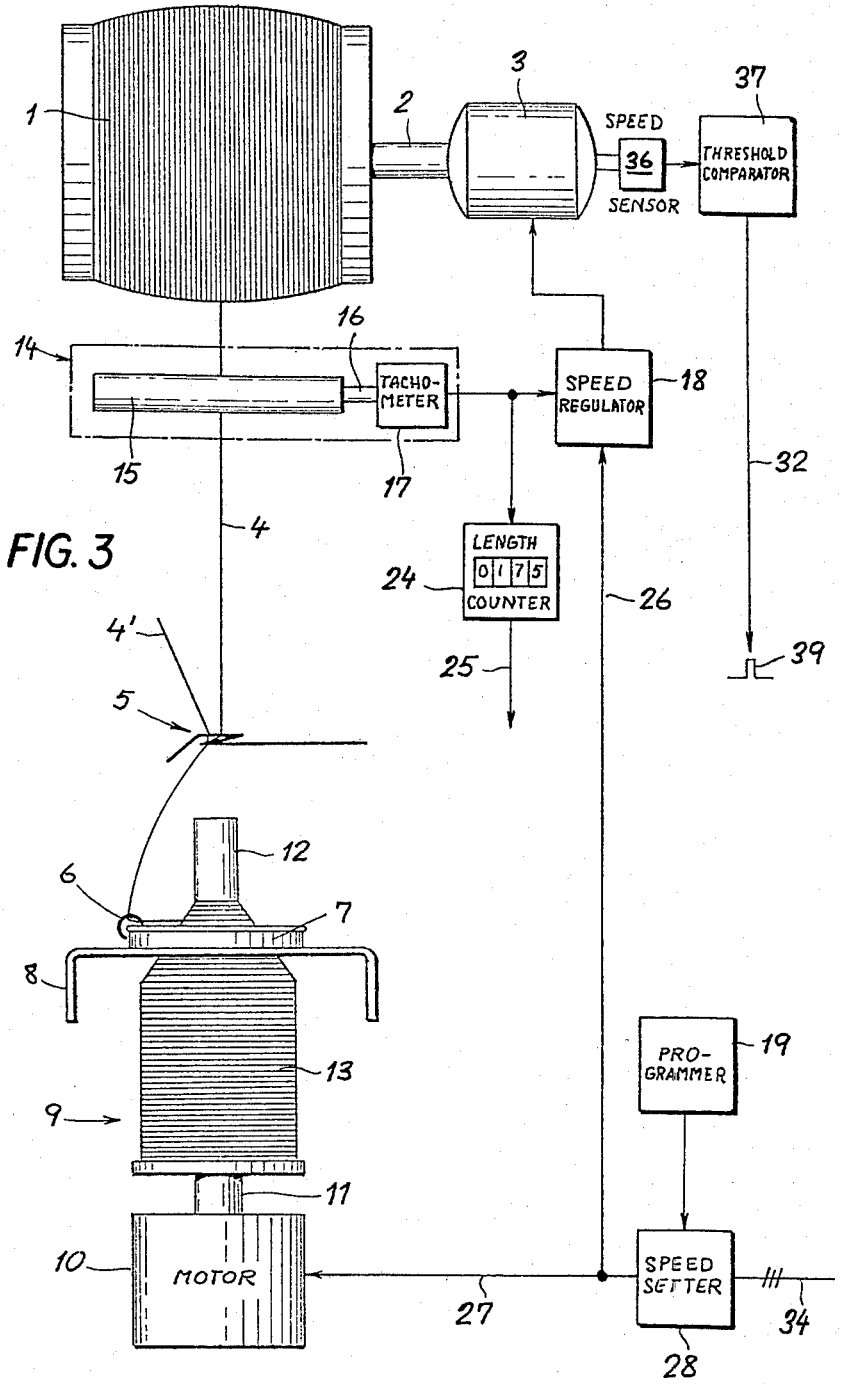
FIGS. 3 and 4 are views similar to FIG. 1, showing other modifications.

Spindle-drive motor 10 has an input lead 27 which, as shown in FIG. 3, could be energized from a 3-phase power line 34 through a speed setter 28 under the control of programmer 19. The latter varies the motor speed in a predetermined manner, e.g. by increasing it when the upper end of cop 13 is being wound in order to raise the yarn tension which with constant spindle rotation would decrease with smaller diameters. The output signal of speed setter 28 is fed via a line 26 to speed regulator 18 for modifying the threshold of its comparator in a corresponding manner, generally as described for the operation of programmer 19 in FIG. 1, for the maintenance of a predetermined ratio between thread advance and spindle rotation. FIG. 3 also shows a thread-length counter 24 which is stepped by metering pulses emitted from tachometer 17 and, on reaching a predetermined count, emits an output signal on a lead 25 to indicate, for example, the completion of a package of desired size. That output signal might be used, in such an instance, to arrest the drives of spindle 11, bobbin 1 and its companion bobbin supplying the thread 4'. Counter 24 may be reset at the start of each cop-winding operation.

Monitoring device 14 may further be used to generate an alarm signal in the event of a thread break. Such a break will let the rollers 15, 15' come to a halt, yet their rotation will continue for a while because of inertia so that a direct measurement of their velocity does not provide a convenient indication of a break. However, an incipient slowdown of roller 15 on account of a rupture of thread 4 will cause the speed regulator 18 to accelerate the motor 3 in an ineffectual attempt to restore the normal thread velocity. Since this effort will be unsuccessful, acceleration will continue until the normal speed range of motor 3 is exceeded. In that event a speed sensor 36 coupled with motor 3 will emit a signal (e.g. a voltage) which, on being supplied to a threshold comparator 37, will result in the generation of an alarm pulse 39 on an output lead 32 of that comparator. Pulse 39 may directly stop the operations of motors 3 and 10 as well as of the motor driving the companion supply bobbin. The threshold set in comparator 37 may lie, for example, at 10% above the maximum bobbin speed.

Figure 5:
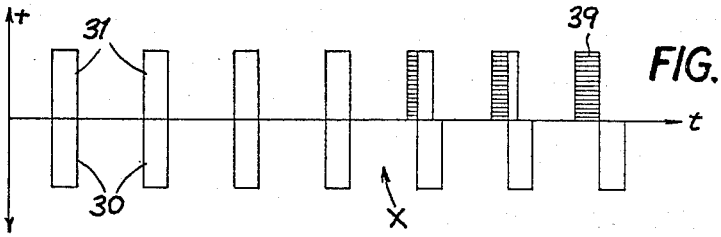
FIG. 5 is a pulse diagram relating to the operation of our improved speed-control system.
Figure 4:
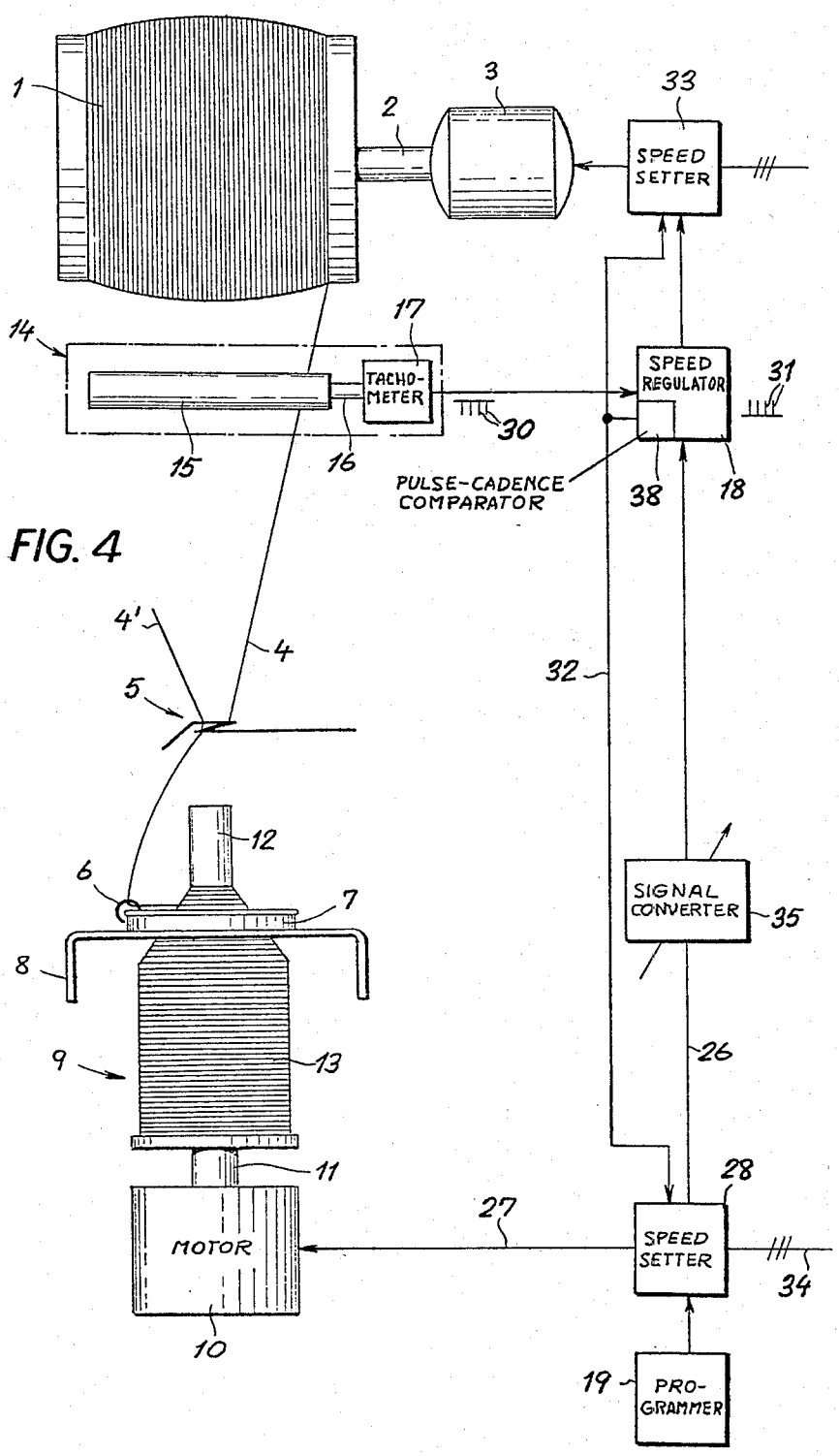

FIG. 4 shows an alternate way of energizing the alarm lead 32 in the event of a thread break. In this instance, as in FIG. 3, speed setter 28 connected to the output of programmer 19 controls not only the adjustable spindle-drive motor 10 but also the speed regulator 18, its output lead 26 being here shown connected to regulator 18 by way of an adjustable signal converter 35 designed to maintain a selected number of twists per unit length of yarn while taking into account the mutually opposite changes in the peripheral thread speed at bobbin 1 and cop 13 in the course of a twisting operation. Such a converter could, of course, also be used in the system of FIG. 3. A pulse-cadence comparator 38 is directly connected to or integrates into speed regulator 18 from which it receives a train of reference pulses 31, of a cadence determined by the control signal on lead 26, along with the metering pulses 30 from tachometer 17. As more clearly illustrated in FIG. 5, where amplitude is plotted against time t, pulses 30 and 31 are of opposite polarities but substantially identical absolute mangitudes so as to cancel one another in a position of coincidence when their recurrence rates are the same. With proper phase adjustment of these pulse trains as they are delivered to comparator 38, normal operation will rsult in such cancellation as indicated at left in FIG. 5. When, however, a break occurs at an instant X, the progressive slowdown of roller 15 will increase the recurrence period of metering pulses 30 with resulting relative disalignment so that comparator 38 will have an output voltage sufficient to generate the alarm and to arrest the spindle and bobbin drives as soon as its integral exceeds a certain threshold. That threshold, of course, ought not to be so low as to stop the operation in response to a minor phase shift; a signal lamp energized by the comparator 38 at subthreshold voltages may indicate to an operator the need for a phase readjustment.

If the twin bobbins supplying the threads 4 and 4' are carried on the same shaft 2 for joint rotation, either by motor 3 or by speed changer 23, one monitoring device 14 will suffice to control the speed regulator 18. A second such device could then still be used for generating an alarm signal in the event of a break of the corresponding thread.

We claim:

1. In textile machines comprising first drive means for rotating a supply bobbin from which a thread is being drawn through a traveler onto a cop on a spindle rotated by second drive means, the combination therewith of:

monitoring means disposed between said supply bobbin and said traveler for generating a velocity-measuring signal indicative of the rate of advance of a thread being payed out by the bobbin; and speed-regulating means coupled with said first drive means and responsive to said velocity-measuring signal for controlling the rotation of said supply bobbin to maintain said rate of advance at a prescribed value.

2. The combination defined in claim 1, further comprising programming means coupled with said speed-regulating means for varying said prescribed value in a predetermined manner.

3. The combination defined in claim 2 wherein said programming means is coupled with said speed-regulating means through the intermediary of said second drive means and an output connection from the latter.

4. The combination defined in claim 3, further comprising adjustable signal-conversion means inserted in said output connection.

5. The combination defined in claim 1 wherein said monitoring means comprises a rotary member mechanically entrainable by said thread and a tachometric device coupled with said rotary member.

6. The combination defined in claim 5 wherein said rotary member is one of two coacting rollers clamping said thread between them.

7. The combination defined in claim 5 wherein said tachometric device is a generator of metering pulses of a recurrence frequency proportional to said rate of advance.

8. The combination defined in claim 7, further comprising a thread-length counter coupled to said generator for stepping by said metering pulses.

9. In textile machines comprising first drive means for rotating a supply bobbin from which a thread is being drawn through a traveler onto a cop on a spindle rotated by second drive means, the combination therewith of:

monitoring means disposed between said supply bobbin and said traveler for generating a velocity-measuring signal indicative of the rate of advance of a thread being payed out by the bobbin;

speed-regulating means coupled with said first drive means and responsive to said velocity-measuring signal for controlling the rotation of said supply bobbin to maintain said rate of advance at a prescribed value, said monitoring means comprising a rotary member mechanically entrainable by said thread and a tachometric device coupled with said rotary member, being a generator of metering pulses of a recurrence frequency proportional to said rate of advance; and alarm means coupled to said generator for arresting said first and second drive means in response to a significant decrease in the recurrence frequency of said metering pulses.

10. The combination defined in claim 9 wherein said alarm means comprises a comparator receiving said metering pulses from said generator and a train of reference pulses from said speed-regulating means.

11. The combination defined in claim 10 wherein said metering pulses and said reference pulses are of like absolute magnitude and opposite polarities for canceling in said comparator upon coinciding with each other.

12. In textile machines comprising first drive means for rotating a supply bobbin from which a thread is being drawn through a traveler onto a cop on a spindle rotated by second drive means, the combination therewith of:

monitoring means disposed between said supply bobbin and said traveler for generating a velocity-measuring signal indicative of the rate of advance of a thread being payed out by the bobbin;

speed-regulating means coupled with said first drive means and responsive to said velocity-measuring signal for controlling the rotation of said supply bobbin to maintain said rate of advance at a prescribed value; and sensing means coupled to said monitoring means for emitting an alarm signal in response to a significant slowdown in said rate of advance.

13. The combination defined in claim 12 wherein said sensing means is coupled to said monitoring means through the intermediary of said speed-regulating means and said first drive means for generating said alarm signal upon detection of an excessive operating speed of said first drive means caused by feedback from said monitoring means rendered ineffectual in the event of a thread break.

14. The combination defined in claim 13 wherein said sensing means includes a threshold comparator with output connections to said first and second drive means for arresting same upon detection of said excessive operating speed.

* * * * *